US008213151B2

(12) United States Patent
Nelson et al.

(10) Patent No.: US 8,213,151 B2
(45) Date of Patent: Jul. 3, 2012

(54) METHODS AND SYSTEMS FOR DEFINING ADDRESSES FOR PYROTECHNIC DEVICES NETWORKED IN AN ELECTRONIC ORDNANCE SYSTEM

(75) Inventors: Steven Nelson, Huntington Beach, CA (US); Joe Carvalho, Hollister, CA (US); Michael N. Diamond, Thousand Oaks, CA (US)

(73) Assignee: Pacific Scientific Energetic Materials Company (California), LLC, Valencia, CA (US)

( * ) Notice: Subject to any disclaimer, the term of this patent is extended or adjusted under 35 U.S.C. 154(b) by 431 days.

(21) Appl. No.: 12/347,905

(22) Filed: Dec. 31, 2008

(65) Prior Publication Data

US 2012/0137914 A1 Jun. 7, 2012

(51) Int. Cl.
*F23Q 21/00* (2006.01)

(52) U.S. Cl. ..... 361/248; 361/249; 701/45; 280/728.1; 102/200; 102/206; 102/360

(58) Field of Classification Search ..... 361/248, 361/249; 701/45; 280/728.1; 102/200, 206, 102/360

See application file for complete search history.

(56) References Cited

U.S. PATENT DOCUMENTS

| | | | | |
|---|---|---|---|---|
| 6,152,011 | A * | 11/2000 | Ivy et al. | 89/1.814 |
| 6,173,651 | B1 * | 1/2001 | Pathe et al. | 102/218 |
| 6,275,756 | B1 * | 8/2001 | Griggs et al. | 701/45 |
| 6,283,227 | B1 * | 9/2001 | Lerche et al. | 175/4.55 |
| 6,300,764 | B1 * | 10/2001 | Kelley | 324/502 |
| 6,584,907 | B2 * | 7/2003 | Boucher et al. | 102/217 |
| 7,644,661 | B1 * | 1/2010 | Nelson et al. | 102/202.5 |
| 7,752,970 | B2 * | 7/2010 | Nelson et al. | 102/215 |
| 7,762,189 | B2 * | 7/2010 | Ritchie et al. | 102/202.7 |
| 2005/0183605 | A1 | 8/2005 | Bishop et al. | |
| 2005/0188871 | A1 * | 9/2005 | Forman et al. | 102/200 |
| 2008/0156218 | A1 | 7/2008 | Ritchie et al. | |
| 2009/0314175 | A1 * | 12/2009 | Nelson et al. | 102/218 |
| 2011/0011293 | A1 * | 1/2011 | Nelson et al. | 102/215 |

* cited by examiner

*Primary Examiner* — Patrick Salce
(74) *Attorney, Agent, or Firm* — Perkins Coie LLP

(57) ABSTRACT

In networked electronic ordnance systems as disclosed herein, a plurality of pyrotechnic devices communicate with a controller along a common bus. In accordance with an embodiment of the disclosure, at least some of the pyrotechnic devices in the ordnance system are configured such that the address for those devices can be defined during or subsequent to installation of the pyrotechnic devices in an end system. In some instances, a logic device in the pyrotechnic device includes a diagnostics block that initiates a suite of diagnostic tests within the pyrotechnic device in response to a diagnostics command received by the pyrotechnic device. Additionally, in some instances, an additional safety mechanism is added to an energy-reserve capacitor in the pyrotechnic device in compliance with a safe-by-wire standard.

25 Claims, 11 Drawing Sheets

METHODS AND SYSTEMS FOR DEFINING ADDRESSES FOR PYROTECHNIC DEVICES NETWORKED IN AN ELECTRONIC ORDNANCE SYSTEM

FIELD

The following disclosure generally relates to a networked electronic ordnance system, including methods and systems for defining addresses for pyrotechnic devices that are networked in the electronic ordnance system, for performing a suite of diagnostic tests within the pyrotechnic devices, and for adding additional safety mechanisms to the pyrotechnic devices.

BACKGROUND

The term "pyrotechnics" refers to materials capable of undergoing self-contained and self-sustained exothermic chemical reactions for the production of heat, light, gas, smoke, and/or sound. Pyrotechnic devices, using such pyrotechnic materials, are widely used in a number of aeronautical, aerospace, and even land-vehicle applications. Examples of pyrotechnic devices include explosive bolts, bolt cutters, separation fairings, actuators, engine igniters, etc.

In aeronautical and aerospace applications, for example, such pyrotechnic devices can be used for performing various functions such as separating one structure from another, releasing a structure from a stowed position to a deployed position, etc. Considering the specific example of a missile, a number of pyrotechnic devices may be assembled within the missile to perform a variety of operations. For example, one or more pyrotechnic devices may be used for engine ignition during the launch of the missile. Another set of pyrotechnic devices may be used at a later stage during the flight of the missile to achieve stage separation, etc. Similarly, in land-vehicle applications such as automobiles, pyrotechnic devices are now commonly used in the deployment of airbags.

Such pyrotechnic devices include several components, including an initiator, which in response to suitable electrical signals, initiates (or deploys) the devices. The pyrotechnic devices may also include an electronic assembly to control and coordinate the initiation of the initiator. One or more of these pyrotechnic devices are installed in an end system (e.g., airbag deployment systems, cruise missiles, etc.), where they are used through controlled deployment.

In some instances, each pyrotechnic device installed in the end system may perform the same function (e.g., bolt cutters in different sections of a launch vehicle). In other instances, as indicated above, different pyrotechnic devices may perform different functions (e.g., a group of pyrotechnic devices may be used as engine igniters and another group may be used as bolt cutters in a launch vehicle). In either case, a particular pyrotechnic device should be capable of being uniquely signaled such that a command (e.g., a firing command) can be transmitted to that particular pyrotechnic device. It is important to accurately identify these devices because a signal routed inadvertently to an unintended device may result in uncontrolled deployment in the end device.

BRIEF DESCRIPTION OF DRAWINGS

These and other objects, features and characteristics of the present invention will become more apparent to those skilled in the art from a study of the following detailed description in conjunction with the appended claims and drawings, all of which form a part of this specification. In the drawings:

DETAILED DESCRIPTION

By networking electronic ordnance systems, one or more pyrotechnic devices can communicate with a controller along a bus. In accordance with an embodiment of the disclosure provided herein, at least some of the pyrotechnic devices in the networked electronic ordnance system are configured such that the address for those devices can be defined before, during or subsequent to installation of the pyrotechnic devices in an end system. In one embodiment, logic devices included in the pyrotechnic devices include a mode pin that enables a unique address to be acquired by the pyrotechnic device in situ at the end system.

In addition to the addressing systems and methods discussed above, a logic device in a pyrotechnic device to be utilized in a networked ordnance system further includes a diagnostics block that initiates a suite of diagnostic tests within the pyrotechnic device in response to a diagnostics command received by the pyrotechnic device.

Additionally, the networked electronic ordnance system discussed herein is further configured to be in compliance with a safe-by-wire plus standard. The pyrotechnic devices are configured in a parallel orientation in compliance with the safe-by-wire standard. In one embodiment, an additional safety mechanism is added to an energy-reserve capacitor in the pyrotechnic device in compliance with the safe-by-wire standard.

A networked electronic ordnance system in accordance with the techniques described herein may be used in numerous kinds of aeronautical and aerospace devices, such as tactical missiles, cruise missiles, surface-to-air missiles, launch vehicles, satellites, etc (collectively referred to herein as "end devices"). In such examples, the electronic ordnance network system may be used to initiate the function of various explosive or pyrotechnic effectors (hereinafter, "pyrotechnic devices") such as exploding bolts, bolt cutters, frangible joints, actuators, penetration charges, fragmentation charges, gas generators, inflators, motor igniters, through bulkhead initiators, explosive transfer lines, separation devices, pyrotechnically actuated valves, etc. Pyrotechnic devices are also used in land vehicles that utilize reactive effectors, such as in automotive air bag deployment systems.

Figure 1:
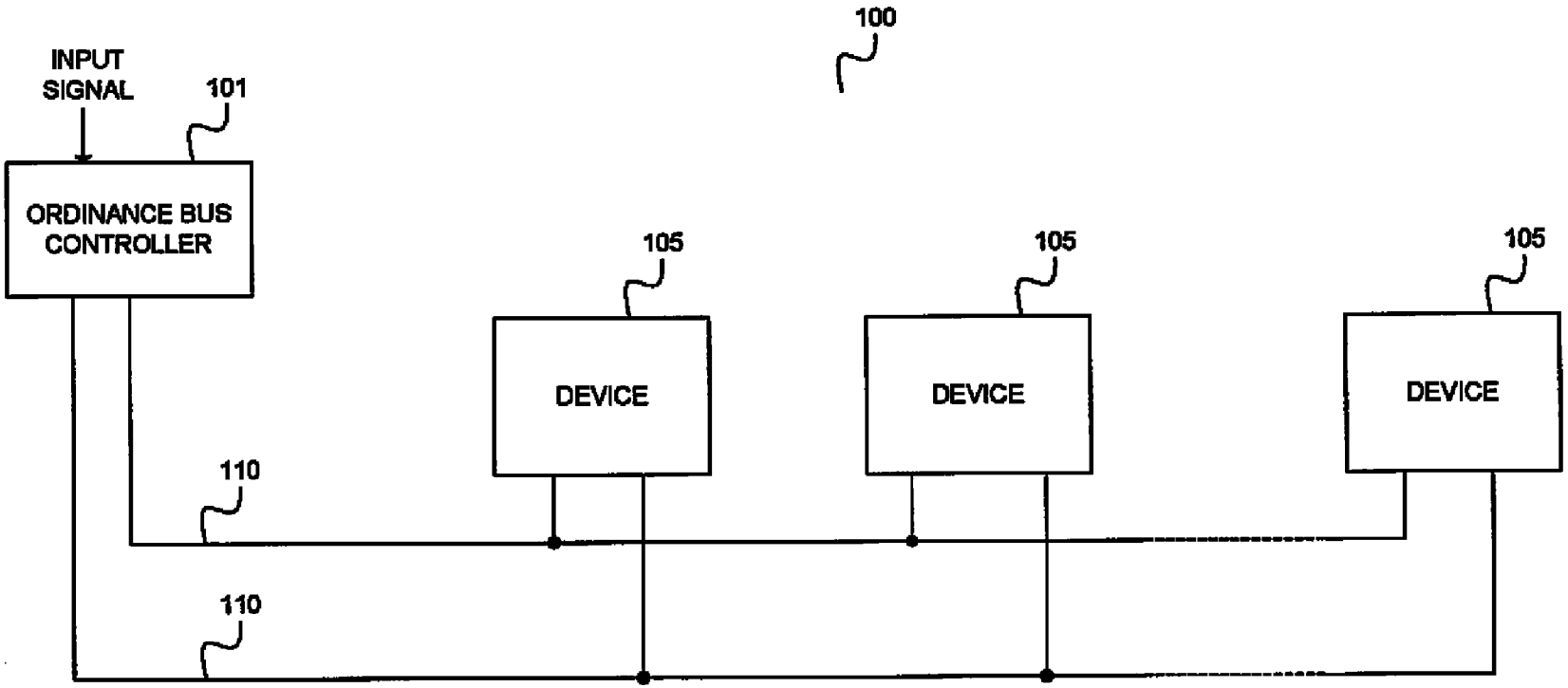
FIG. 1 illustrates an embodiment of a networked electronic ordnance system.

FIG. 1 illustrates an embodiment of a networked electronic ordnance system 100. The networked electronic ordnance system 100 includes a number of pyrotechnic devices 105 interconnected, in some instances, by a cable network 110, also referred to as a bus network. In one embodiment, the bus network 110 connects the pyrotechnic devices 105 to an ordnance bus controller 101.

In some instances, the bus network 110 is formed from at least one two-wire cable that provides voltage, power, and control signals to the pyrotechnic devices 105. The term "bus network," as used in this document, may refer to multiple strands of wire, a single wire, or other appropriate conductors, such as flexible boards. In one embodiment, the bus network 110 is utilized to transmit both electric power and data signals to each of the pyrotechnic devices 105 connected to the bus network, thus eliminating the need for separate power and signal cables.

In one embodiment, the pyrotechnic devices 105 are connected in a parallel bus configuration (as shown in FIG. 1) in compliance with the safe-by-wire plus (SBWP) standard. The SBWP standard, which encompasses an automotive safety restraints bus specification (ASRB), provides the specification of a two-wire serial communications and power distribution bus for an automotive occupant safety restraints system.

Here, in compliance with the SBWP standard, each pyrotechnic device 105 is connected in a parallel bus configuration, where each pyrotechnic device is directly connected to the two bus wires Bus-A and Bus-B. In such a parallel connection, the bus wires may be routed in a bus, tree, or ring structure, or combinations of such structures in accordance with the SBWP standard.

Figure 2A:
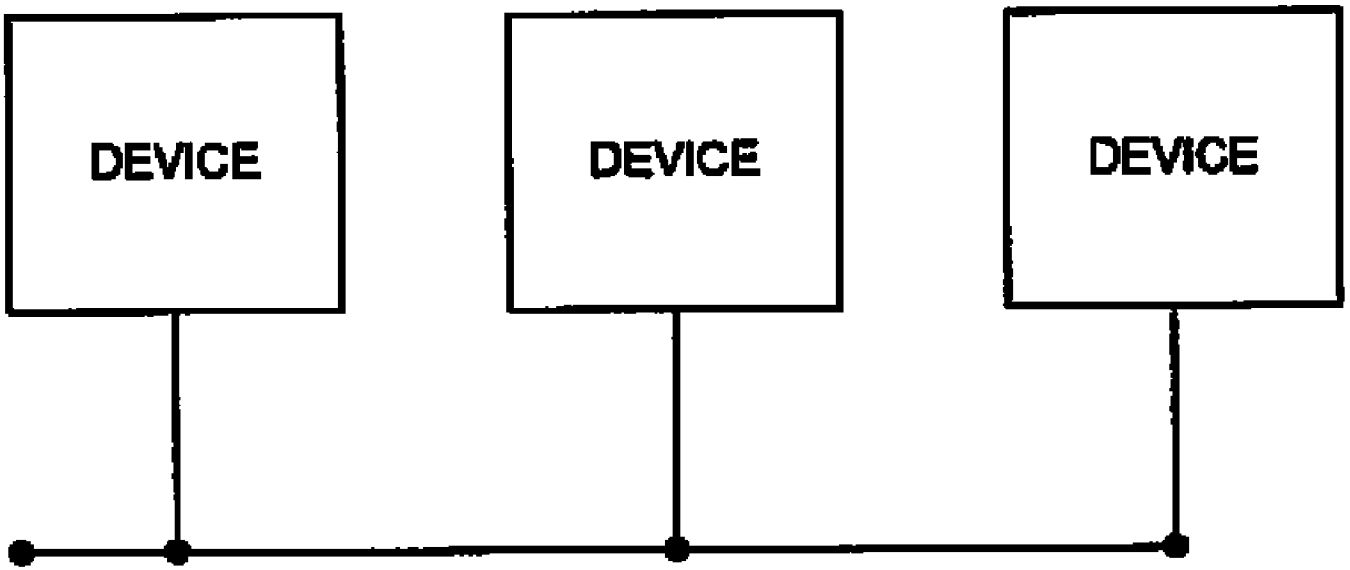
FIGS. 2A-2C provide examples of pyrotechnic devices in parallel configuration in accordance with the SBWP bus topology specification.
Figure 2B:
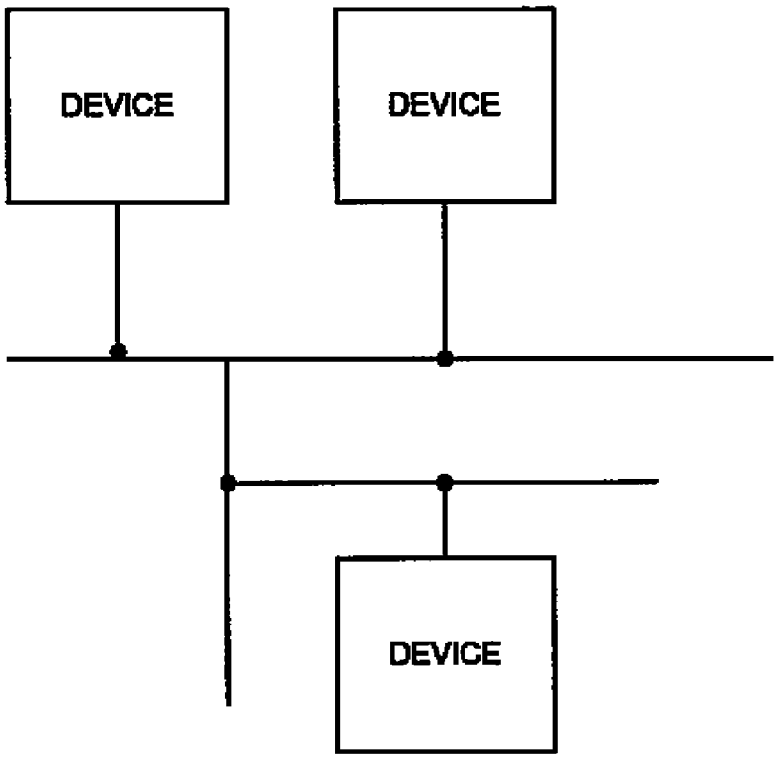
Figure 2C:
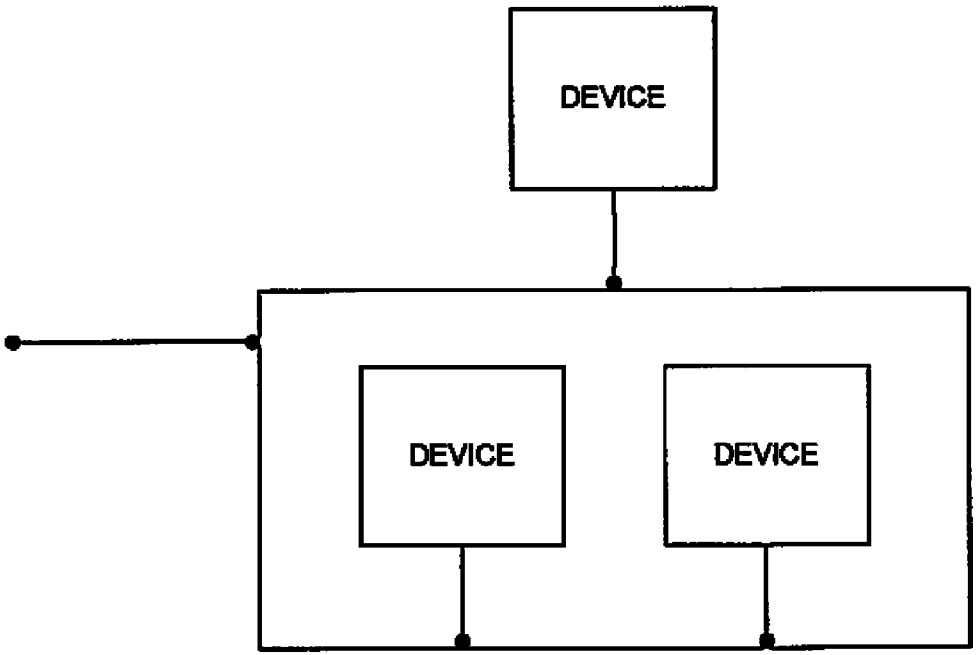

FIGS. 2A-2C provide examples of pyrotechnic devices in parallel configuration in accordance with the SBWP bus topology specification. FIG. 2A is an example of a parallel configuration with the wires routed in a bus structure. FIG. 2B is another example of a parallel configuration where the wires are routed in a tree structure. FIG. 2C is another example where the wires are routed in a ring structure.

In other embodiments, the pyrotechnic devices 105 may be connected serially using the network bus. Serial connections may be advantageous in applications where packaging, weight, and/or simplicity are particularly important. The serial connection may be established by connecting each of the pyrotechnic devices 105 to a single serial bus, by daisy-chaining the pyrotechnic devices together, or by other serial connection strategies.

Referring again to FIG. 1, the ordnance bus controller 101 performs testing upon, and controls the address encoding, arming, and firing of the pyrotechnic devices 105 via the bus network 110. The ordnance bus controller 101 includes or consists of a logic device programmed with instructions for controlling the test and operation of the pyrotechnic devices 105 connected to it through the bus network 110. The ordnance bus controller 101 may be an application specific integrated circuit (ASIC), a microprocessor, a field-programmable gate array (FPGA), discrete logic, another type of logic device, or a combination thereof.

Depending on the application or the end system in which the ordnance bus controller 101 is used, the ordnance bus controller 101 may itself be connected to a fire control system or information handling system associated with the vehicle or device (i.e., the end system) in which the networked electronic ordinance system 100 is used. Alternatively, the ordnance bus controller 101 may be incorporated into or otherwise combined with one or more processors or information handling systems in the end system in which the networked electronic ordnance system 100 is used. Further, the ordnance bus controller 101 may stand alone, and receive input signals from a human or mechanical source.

The pyrotechnic devices 105, as indicated above, may be any device capable of initiation, such as, for example, rocket motor igniters, thermal battery igniters, bolt cutters, cable cutters, explosive bolts, etc. In some instances, the pyrotechnic devices 105 connected to an ordnance bus controller 101 are all of one particular type (e.g., bolt cutters). In other instances, the pyrotechnic devices 105 connected to the ordnance bus controller 101 may be a combination of different types (e.g., a cable cutter and an explosive bolt connected to the same ordnance bus controller 101).

Figure 3:
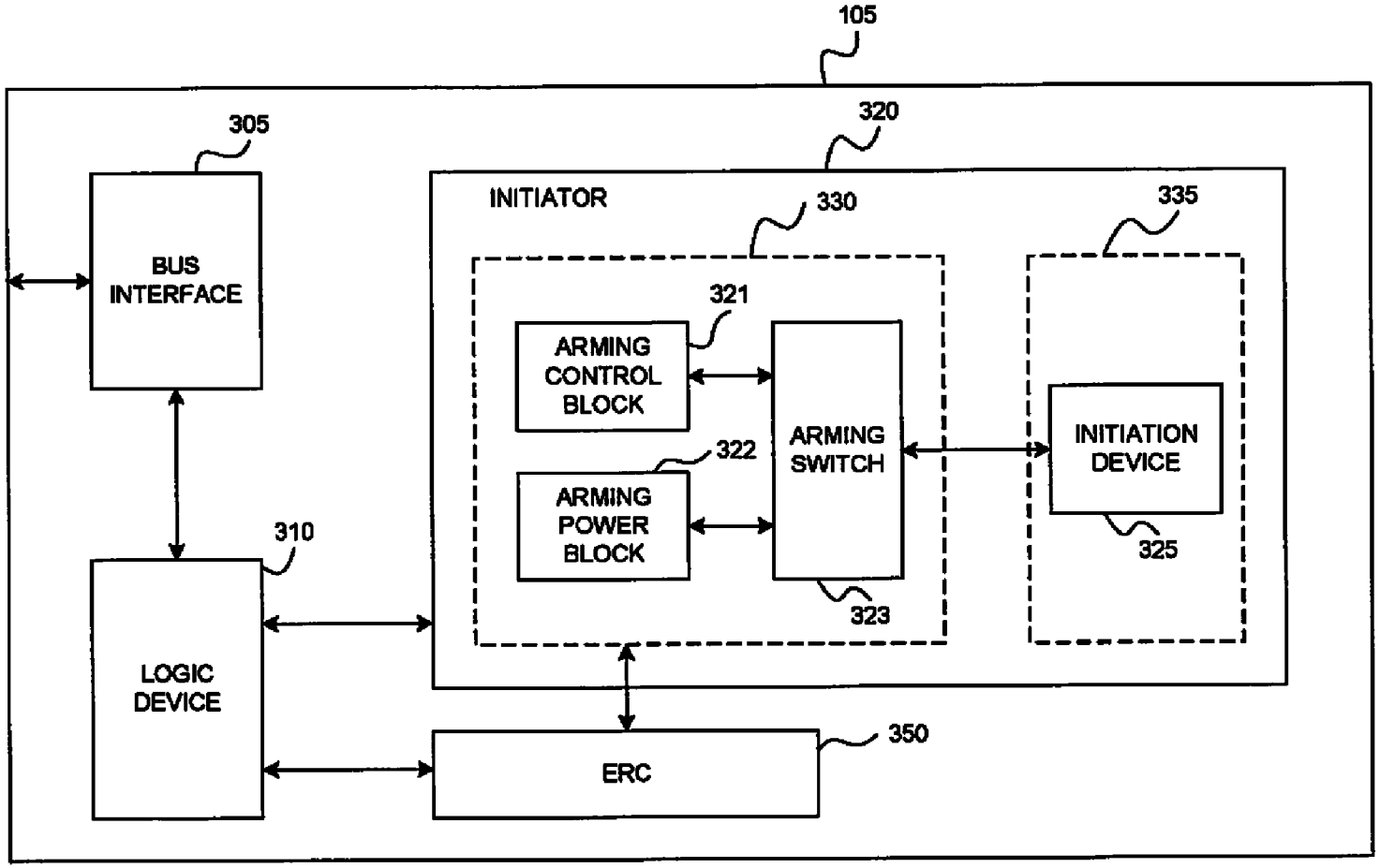
FIG. 3 is a block diagram illustrating an embodiment of a pyrotechnic device.

FIG. 3 is a block diagram illustrating an embodiment of a pyrotechnic device 105. In one embodiment, the pyrotechnic device 105 includes a bus interface 305. In some instances, the bus interface 305 is an electronic component that receives signals (e.g., power and data signals) from the bus network 110 before further transmitting the signals within the pyrotechnic device 305.

The pyrotechnic device 105 includes a logic device 310 electrically connected to the bus interface 305. In some embodiments, the pyrotechnic device 105 may operate without a separate bus interface 305, in which case, the logic device 310 is directly connected to the bus network 110. The components and functioning of the logic device 310 are explained in greater detail with reference to FIG. 5 below.

The pyrotechnic device 105 further comprises an initiator 320. The initiator 320 includes at least an electronic assembly 330 and a pyrotechnic assembly 335. The electronic assembly 330 receives firing or arming commands and directs it to the pyrotechnic assembly 335 for firing. The term "initiator," as used herein, refers to the combination of the electronic assembly 330 and the pyrotechnic assembly 335. Thus, for example, a pyrotechnic device 105 such as a bolt cutter or a cable cutter will include an initiator 320 that, upon firing, exerts force on one or more components of the pyrotechnic device 105 to produce a bolt-cutting or cable-cutting action.

In one embodiment, the electronic assembly 330 of the initiator 320 is an ASIC enclosed in a separate package. In other embodiments, the components of the electronic assembly 330 may be included within the logic device 310 ASIC. In an exemplary embodiment, the electronic assembly 330 includes an arming control block 321 and an arming power block 322. The arming control block 321 receives an arming command received through the bus network 110. In some instances, the arming control receives the arming command from the bus network 110 through the logic device 310.

The arming power block 322 receives power from an energy reserve capacitor (ERC) 350 included in the pyrotechnic device. In some instances, the ERC 350 is located within the electronic assembly 330 of the initiator 320. In other instances, as illustrated in FIG. 3, the ERC 350 is located outside of the initiator 320. Upon the arming control block receiving the arming command, the ERC 350 begins to charge using power, for example, from the bus network 110. Upon completion of charging, the ERC 350 provides a deployment charge to the arming power block 322. Upon receipt of the deployment charge from the arming power block 322 and the arming commands from the arming control block 321, the arming switch 323 is activated.

In one embodiment, the ERC 350 receives an external charge command through the bus network 110. In some instances, the external charge command is routed to the ERC 350 through the bus interface 305. In other instances, the external charge command is routed to the ERC 350 through the logic device 310. In either case, the external charge command is independent of the arming command routed to the arming control block 320 of the initiator. In such an embodiment, the ERC 350 delivers the deployment charge to the arming power block only upon the receipt of the external charging command. This additional safety mechanism, additionally in compliance with the SBWP standard, protects the pyrotechnic device from inadvertently deploying.

Figure 4:
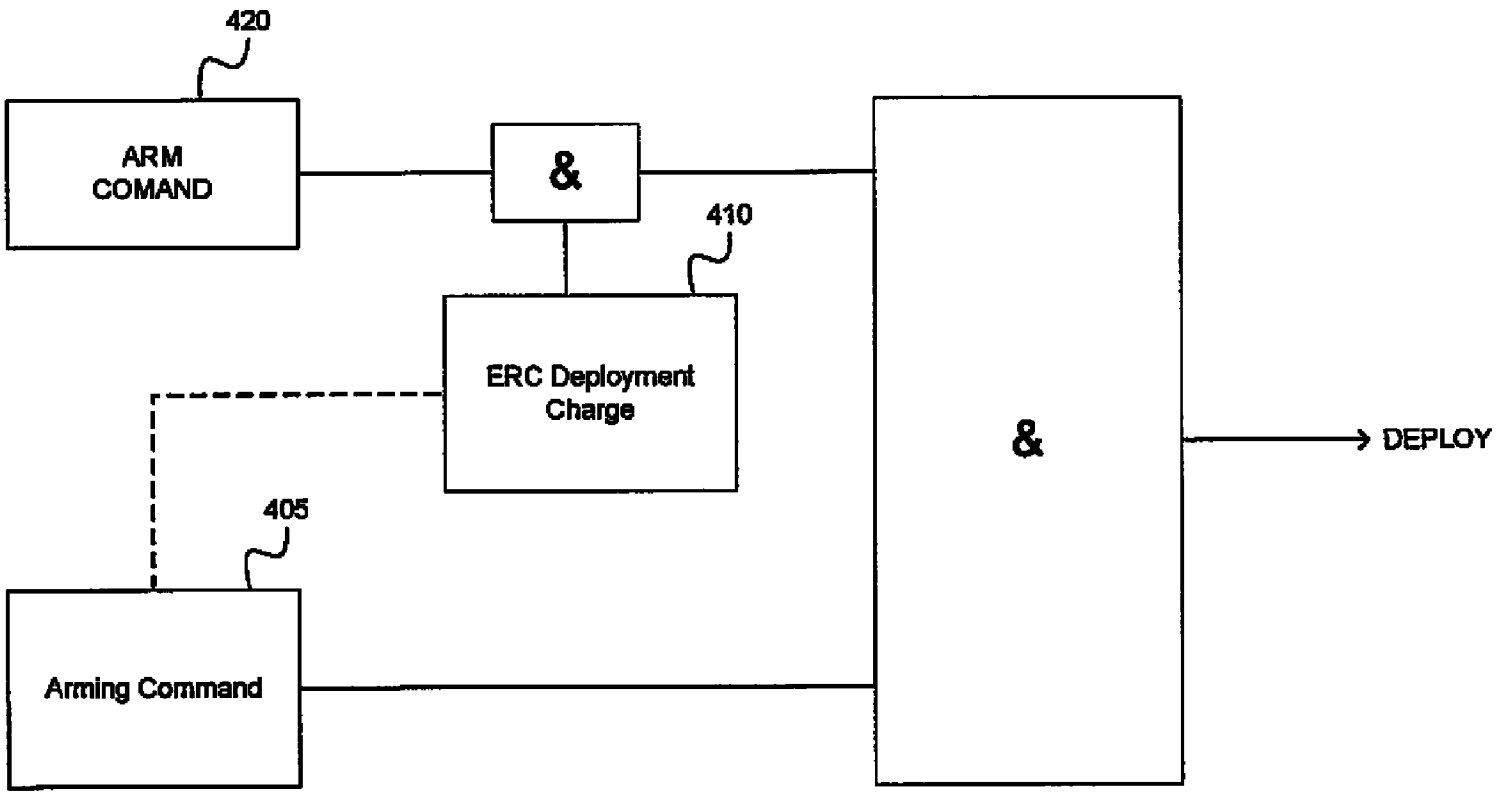
FIG. 4 is a flow diagram illustrating the ERC safety mechanism in accordance with the SBWP standard.

This safety mechanism is further illustrated with reference to FIG. 4. In one embodiment, the electronic assembly of the pyrotechnic device receives an arming command 405 transmitted through, for example, the bus network. The electronic assembly separately receives an external ERC charge command 410 through, for example, the bus network. Separately, as indicated above, the ERC charges up upon receipt of the arming command and provides an ERC deployment charge 410. As indicated in FIG. 4, the ERC deployment charge is conveyed to the next stage only when the external ERC charge command 420 is combined with the ERC deployment charge 410. At the next stage, the ERC deployment charge is then combined with the arming command 405 to cause the pyrotechnic device to deploy.

Referring back to FIG. 3, the deployment charge supplied by the ERC 350 (routed via the arming power block 322 and then the arming switch 323) is such that it is sufficient to activate an initiating device 325 in the pyrotechnic assembly 335, in order to deploy the pyrotechnic device 105. The type of initiating device 325 used varies depending on the application for which the networked electronic ordnance system 105 is used. In one embodiment, a thin film bridge initiating device is placed directly on a substrate onto which the logic device 310 and the electronic assembly 330 are mounted. Other types of initiating devices, as known to one of ordinary skill in the art, may be used as well. Examples of such initiating devices include an initiating device in which a bridge wire passes through a pyrotechnic material or a semiconductor bridge where a thin bridge connects two larger lands.

In one embodiment, circuit traces on a substrate connect the logic device 310 to the initiator 320. By using circuit traces to connect the logic device 310 to the initiator 320, the need for wire bonding to the thin film bridge initiating device is eliminated, simplifying packaging and increasing reliability. However, wire bonding or other types of connection may be used to connect the logic device 310 to the initiator 320, if desired.

Figure 5:
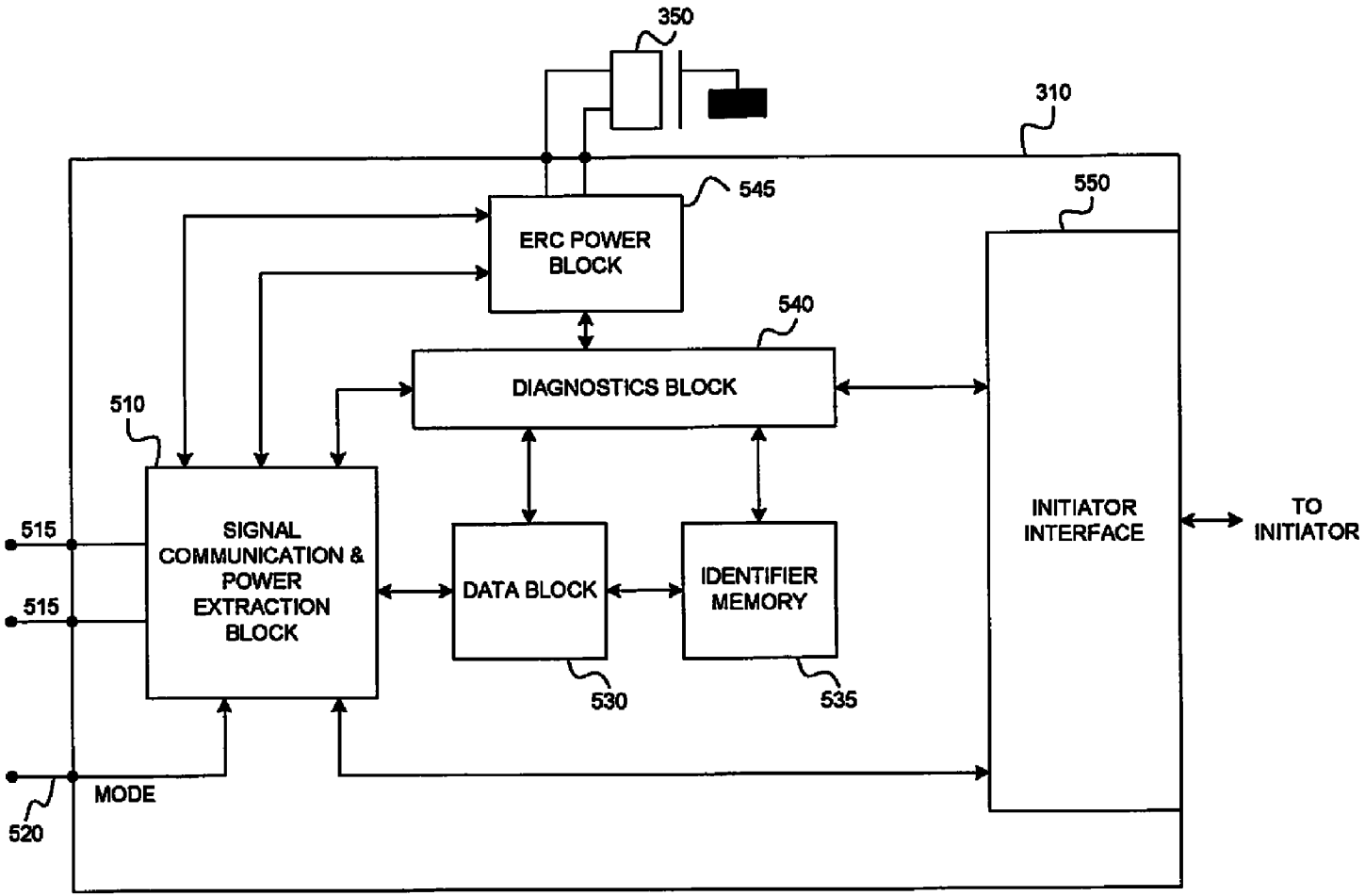
FIG. 5 is a schematic diagram illustrating an embodiment of the logic device.

FIG. 5 is a schematic diagram illustrating an embodiment of the logic device 350 included in a pyrotechnic device 105. In one embodiment, the logic device 350 within each pyrotechnic device 105 is an application specific integrated circuit (ASIC). In other embodiments, the logic device 350 includes any other appropriate logic device, such as but not limited to a microprocessor, a field-programmable gate array (FPGA), discrete logic, or'a combination thereof.

In one embodiment, the logic device comprises a signal communication and power extraction block 510. The signal communication and power extraction block 510 enables the logic device 310 to interface with a bus interface 305 of the pyrotechnic device 105. In some instances, the signal communication and power extraction block 510 enables the logic device 310 to interface directly with the bus network. In one embodiment, the signal communication and power extraction block 510 interfaces with a two wire bus network 515 by means of two bus interface pins.

The signal and power extraction block 510 communicates with the bus network 515 to receive data signals (e.g., arming commands, ERC charge commands, etc.) received, for example, from the ordnance bus controller 101. The data signals are then routed to other logic blocks (e.g., ERC power block 545, diagnostics block 540, etc.) of the logic device 310 or the initiator 320 of the pyrotechnic device 105. As indicated above, in one embodiment, the ordnance system uses an unshielded twisted pair cable for the bus network in compliance with the SBWP standard. The twisted pair cable transmits both electric power and data signals, thereby eliminating the need for separate power and signal cables.

The signal communication and power extraction block 510 thus extracts the electric power from the bus network 515 and conveys power as needed for the various control and logic blocks (e.g., ERC power block 545).

Each logic device 310 and associated pyrotechnic device can have a unique identifier. The networked electronic ordnance system 100 uses the unique identifier of the logic device 310 to identify and transmit specific commands (e.g., an arming command) to a specific pyrotechnic device 105 in the networked electronic ordnance system 100. As discussed above, the networked electronic ordnance system 100 may comprise multiple pyrotechnic devices 105 connected to the network bus 110.

Each of the multiple pyrotechnic devices 105 may be configured to perform different actions (e.g., bolt cutter, cable cutter, etc.). Even if all of the pyrotechnic devices 105 in the ordnance system 101 perform the same action, the devices may be arranged in an end system such that each pyrotechnic device operates on a different part or location of the end system. Therefore, if a plurality of pyrotechnic devices 105 are connected along the same bus, to send commands to a device individually, that device needs to be identified based on a unique identifier (or, a unique address) to ensure that such commands are accurately routed.

In some instances, the unique address is a code that is stored as a data object within the logic device 310. Specifically, the unique address may be a code that is permanently stored in an identifier memory 535 of the logic device 310. Although a unique identifier may be assigned each time the networked electronic ordnance system 100 is powered up, encoding the address permanently in the hardware (i.e., the identifier memory 535) of the logic device substantially reduces any risk that two pyrotechnic devices 105 end up with an identical address at a later time.

In some instances, the unique address is a digital code, and may be encoded using any addressing scheme known to a person of ordinary skill in the art. By way of example and not limitation, the unique address may be defined as a single bit within a data word having at least as many bits as the number of pyrotechnic devices 105 in the networked electronic ordnance system 100. All bits in the word are set low except for one bit. The position of the high bit within the word serves to uniquely identify the particular logic device 310, and hence the corresponding pyrotechnic device 105. Other unique identifiers or addresses may be used, such as numerical codes, alphanumeric strings, etc.

The logic device 310 includes a data block 530 that enables the pyrotechnic device 105 to be encoded with a unique address. The data block 530 communicates with a memory (the identifier memory 535) of the logic device 310 to store the unique address.

In known systems, the pyrotechnic devices are tagged with identifiers (i.e., preprogrammed) before being installed in the end system. In one example of a known system, the identifier is inscribed or printed on a package that houses the pyrotechnic device. In another example, the pyrotechnic device is encoded with a digital address that is stored within the pyrotechnic device. In either case, an operator assembling or arranging the end system is required to utilize the identifier that has already been assigned to the pyrotechnic device and therefore must track each pyrotechnic device in association with its corresponding preprogrammed address. In other words, the bus controller must be configured in accordance with the pre-programmed addresses corresponding to the pyrotechnic devices to be used in the networked system. The preprogramming therefore restricts flexibility in installation of the electronic ordnance system in the end system.

Such known pre-programmed systems as discussed above may suffer safety issues. Because the pyrotechnic devices within an electronic ordnance system are already associated with permanent addresses before they are installed to the end system, the operator of the end system has to manually track the correlation of the location of each device to its address. This correlation is subsequently used in issuing commands (e.g., firing commands) to the pyrotechnic devices. Any error made by the operator in correlating the device to its location could result, for example, in firing commands issued to unintended devices, leading to safety issues.

In contrast to the prior art solutions and in accordance with the techniques described herein, the unique address is not pre-encoded or stored in the identifier memory 535, thereby enabling address programming of the networked electronic ordnance system 101 at any time prior to, during, or even after installation in the end system. As will be discussed in further detail below, the unique address can be stored in the logic device after the logic device has been installed (or when the logic device is being installed) in the end system.

In one embodiment, the package housing the logic device (i.e., housing the integrated circuit containing the logic device) includes a mode pin 520. As indicated above, the logic device 310 is not initially assigned a unique address. The networked electronic ordnance system 100 is installed in the end system, at which time none of the pyrotechnic devices 105 carry a unique address. Subsequent to (or during) the installation of the networked electronic ordnance system 100 in the end system, the mode pin can then be utilized to encode each pyrotechnic device with a unique address.

In one embodiment, the mode pin 520 is not connected to the bus network 515, and is operated using a separate bus (not shown) independent of the bus network 515. The separate bus may be utilized to set the mode pin 520 at a specific logic state (e.g., a logic high). In some instances, for example, the mode pin 520 of the pyrotechnic device 105 is initially at a default state of logic low level. When the device 105 is to be programmed with a unique address, the mode pin 520 is set at, for example, the logic high value.

In some instances, the mode pin 520 is temporarily connected via a wire or cable to a programming device to program a unique address for the logic device 310 prior to, during, or after installation. The programming device may be a portable (e.g., handheld) device configured to provide a signal to the mode pin 520 to cause the mode pin 520 to be set at the specific logic state. This enables the logic device 310 to enter an address program mode and then receive and store a code that will then become the permanent address for the pyrotechnic device 105. In still other instances, a user may use a connecting means (e.g., a wire-jack, a wire probe, etc.) to connect the mode pin 520 to, for example, a voltage source, and directly apply a voltage to the mode pin 520 to set the mode pin at the specific logic state. In such instances, the user may manually operate on each device in tandem to program each device with a unique address during or subsequent to the devices being installed in the end system.

In one embodiment, the pyrotechnic device 105 (with the mode pin set at the specific logic level) receives the address signal through the bus network 515. In some instances, the ordnance bus controller 101 transmits an address signal through the network bus 515. Here, the logic device 310, with the mode pin 520 set at the specific logic state (i.e., the logic device 310 that is in the address program mode), receives the address signal. The remaining logic devices (i.e., the logic devices with the mode pins not set at the specific logic state) do not accept the address signal. The signal communication and power extraction block 510 receives the address signal and conveys this address signal to the data block 530. In some instances, the signal communication and power extraction block 510 (or the data block 530 in communication with the signal communication and power extraction block) monitors the logic state on the mode pin 520, and acquires the address signal from the network bus 515 when the ordnance bus controller 101 transmits the address signal (when the mode pin is at the specific logic state).

In another embodiment, the pyrotechnic device 105 to be programmed may receive an address signal from an external source. In some instances, for example, the programming device may be used to supply an address signal to the pyrotechnic device 105. As indicated above, the programming device is first used to set the pyrotechnic device 105 at an address program mode (i.e., by setting the mode pin 520 at a specific logic state). The programming device may then clock in the address signal using the mode pin 520. The mode pin 520, as indicated above, is electrically connected to the data block 530 (either directly, or in some instances, through the signal communication and power extraction block 510). In such instances, the data block 530 receives the address signal from the mode pin 520.

In some instances, the data block 530 receives the address signal and generates a corresponding unique address. As indicated above, the data block 530 may use any addressing scheme to encode the address signal to generate the unique address. The data block 530 then stores the generated unique address in the identifier memory 535 of the logic device 310. In other instances, the data block 530 may directly use the received address signal as the unique address and store the received address signal in the identifier memory 535.

Subsequent to storing the unique address in the identifier memory 535, the mode pin 520 is reset to the default logic state value. In some instances, the signal communication and power extraction block 510 of the logic device resets the mode pin 520. In other instances, where a programming device was used to set the mode pin 520 at the specific logic state, the programming device may reset the mode pin 520 subsequent to the logic device 310 receiving the address signal.

As indicated above, a number of pyrotechnic devices may be employed within an end system to perform a variety of operations. For example, in a missile system, a first group of pyrotechnic devices may be used for engine ignition during the launch of the missile. A second group of pyrotechnic devices may be used at a later stage during the flight of the missile to achieve stage separation, etc. Accordingly, in one embodiment, pyrotechnic devices belonging to a one particular group may be encoded with a similar address (e.g., pyrotechnic devices belonging to one group may have an address that has a common "prefix" value). This enables, for example, the ordnance bus controller to transmit commands (e.g., firing commands, diagnostic commands) simultaneously to a common group of pyrotechnic devices by specifying the prefix value.

The following section illustrates how the unique address is used, for example, by the ordnance bus controller 101 to communicate with a pyrotechnic device 105. The ordnance bus controller 101 transmits a digital command signal to a specific logic device by including, for example, an address field, frame, or other signifier in the command signal identifying the specific logic device to be addressed. In some instances, the command signal includes an address frame having the same number of bits as the unique address. All bits in the address frame are set low, except for one bit. The position of the high bit within the address frame corresponds to the unique address of a single pyrotechnic device. Therefore, this exemplary command would be recognized by the logic device having the corresponding unique address.

In some instances, the addressing scheme may be extended to enable the ordnance bus controller 101 to address a group of pyrotechnic devices simultaneously, where the group could range from two pyrotechnic devices to all the pyrotechnic devices. By way of example and not limitation, by setting more than one bit to high in the address frame, a group of pyrotechnic devices may be fired, where the logic device in each pyrotechnic device in that group has a unique address corresponding to a bit set to high in the address frame.

Referring again to FIG. 5, the logic device 310, in one embodiment, includes an ERC power block 545. As indicated above, the pyrotechnic device 105 includes an ERC 350 that provides a deployment charge to the initiator 320 when the initiator 320 receives, for example, a deploy/arming/firing command. In one embodiment, when the initiator 320 receives the arming command, the ERC 350 charges up using power from the bus network 510. In one embodiment, the ERC power block 545 is electrically connected to the ERC 350. The ERC power block 545 communicates with the signal communication and power extraction block 510 to convey the charge power to the ERC 350 upon the initiator 320 receiving the arming command.

Additionally, in compliance with the SBWP standard, the ERC 350 further supplies a deployment charge to the initiator 320 only after receiving an external charge command. This external charge command is independent of the firing or arming command issued by, for example, the ordnance bus controller. In one embodiment, the signal communication and power extraction block 510 of the logic device 310 receives the external charge command from the network bus 515 and routes this external charge command to the ERC power block 545. The ERC power block 545, electrically connected to the ERC 350, thus supplies both the charging power and the external ERC charge command to the ERC 350.

In one embodiment, the logic device 310 includes an initiator interface 550. As discussed above, in some instances, the electronic assembly 330 of the initiator 320 may reside within the logic device 310 (not shown in FIG. 5). In other instances, the electronic assembly 330 of the initiator 320 may reside outside of the logic device 310. In either scenario, the signal communication and power extraction block 510 of the logic device 310 extracts data signals (e.g., arming commands, etc.) and power from the network bus 515 and routes them over to the initiator 320 via the initiator interface 550.

In one embodiment, the logic device 310 also includes a diagnostics block 540. The ordnance bus controller 101 transmits requests to the pyrotechnic device 105 to perform one or more diagnostic tests in the pyrotechnic device. In some instances, the ordnance bus controller transmits a command to the pyrotechnic device 105 to perform a suite of diagnostic tests. In such a scenario, the signal communication and power extraction block 510 of the logic device 310 receives the diagnostic command transmitted through the network bus 515. The signal communication and power extraction block 510 then transmits this command to the diagnostics block 540. The diagnostics block 540, in response to the single diagnostic command, initiates a plurality of diagnostic tests to receive diagnostic results from various components of the pyrotechnic device 105.

In one embodiment, when the diagnostics block 540 receives status indicators or results from each of the components, it generates a digital code representing the status of all the components. The diagnostics block 545 then transmits the code to the signal communication and power extraction block 510, which then transmits the code to the ordnance bus controller 101 through the bus network 515. In some instances, the diagnostics block 540 may also store the results of the diagnostic tests in a local memory (not shown) of the logic device 310. In some instances, the ordnance bus controller 101 may report the results to, for example, a central processor of the networked electronic ordnance system 100 or the end system. In other instances, the ordnance bus controller may simply record the data internally or display it using, for example, a visual medium (e.g., LED indicators, computer monitor, etc.) to an operator or user of the networked electronic ordnance system 100.

The following section describes in detail an example of the diagnostic tests performed by the logic device 310. In one example, the diagnostics block 540 may initiate a diagnostic test to determine whether the firing bridge (of the initiation device 325 of the initiator 320) of the pyrotechnic device 105 is intact. Determining whether the firing element is intact in each initiator 320 is important to verifying the continuing operability of the networked electronic ordnance system 100. The integrity of the firing element is tested, for example, by passing a small controlled amount of current through it. The possible outcomes of the diagnostic test are resistance too high, resistance too low, and resistance in range. If the resistance is too high, the ordnance bus controller 100 infers that the firing element is broken. If the resistance is too low, the ordnance bus controller 100 infers that the firing element is shorted out.

Similarly, the diagnostics block 540 may initiate a diagnostic test to determine the integrity of the ERC by transmitting suitable commands to, for example, the ERC power block. Similar diagnostics may be performed on other components of the pyrotechnic device as well. Thus, the diagnostics block 540 receives a command from the ordnance bus controller and initiates a plurality of diagnostic tests.

This is in contrast with prior art solutions, where, for example, an operator (or a device initiating diagnostic tests) sends out a separate diagnostic test command to perform the diagnostic test on each component of the pyrotechnic device. Because the operator has to issue each command separately, the diagnostic testing of each pyrotechnic device in prior art solutions is time consuming and laborious.

Therefore, the technique described herein with reference to the diagnostics block 540 obviates the need for a user or an operator to send out a separate command to test every component of the pyrotechnic device 105.

Figure 6:
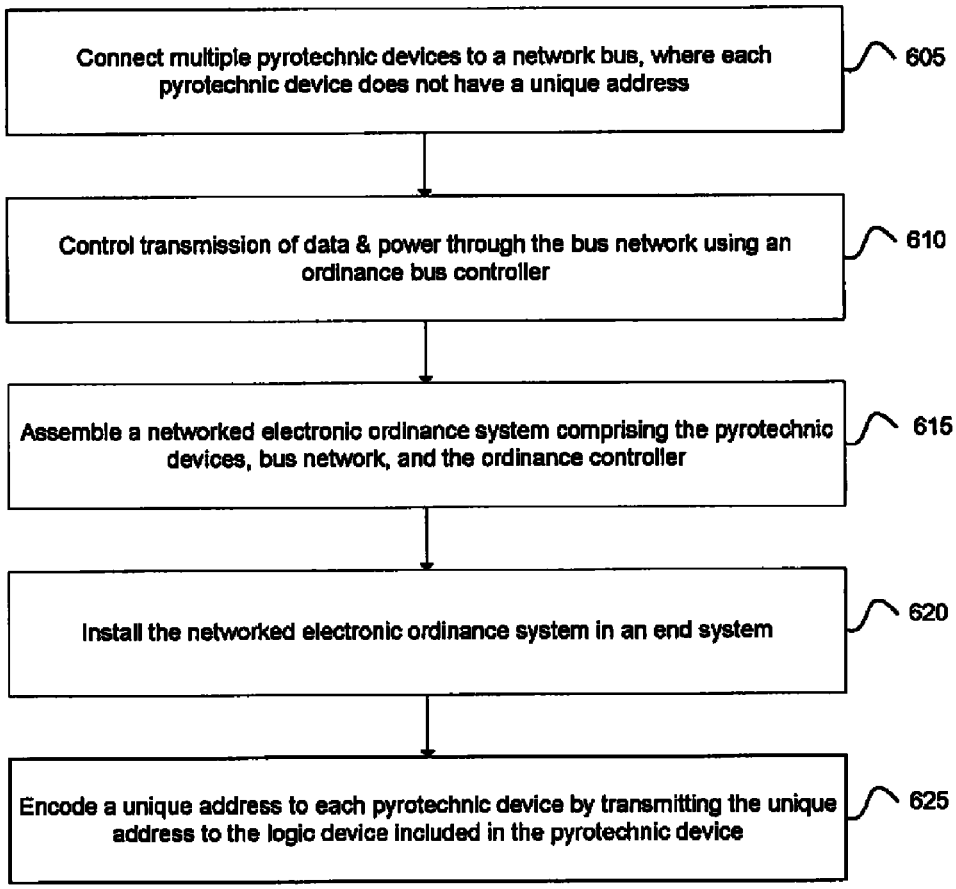
FIG. 6 is a flow diagram depicting an overall method for defining addresses for pyrotechnic devices in a networked electronic ordnance system.

FIG. 6 is a flow diagram depicting an overall method for defining addresses for pyrotechnic devices in a networked electronic ordnance system. In one embodiment, multiple pyrotechnic devices are connected to a bus network 605. Each pyrotechnic device includes a logic device that further includes a memory location to store a unique address to identify the pyrotechnic device. The logic devices, in some instances, are ASIC devices packaged as an integrated circuit. At this point, in some instances, the address memory location does not contain any address. The logic devices are not encoded with the unique address prior to the pyrotechnic devices being installed in an end system.

The multiple pyrotechnic devices connected to the bus network receive power and data signals through the bus network. In one embodiment, the bus network and the data transmitted to the pyrotechnic devices are controlled using an ordnance bus controller 610. The ordnance bus controller, along with the multiple pyrotechnic devices and the bus network are assembled together to form a networked electronic ordnance system 615.

The networked electronic ordnance system is then installed in the end system 620. Subsequent to the networked electronic ordnance system being installed to the end system, the ordnance bus controller transmits a series of unique address signals to selectively enable the logic device in each pyrotechnic device to generate and store a unique address 625.

Figure 7:
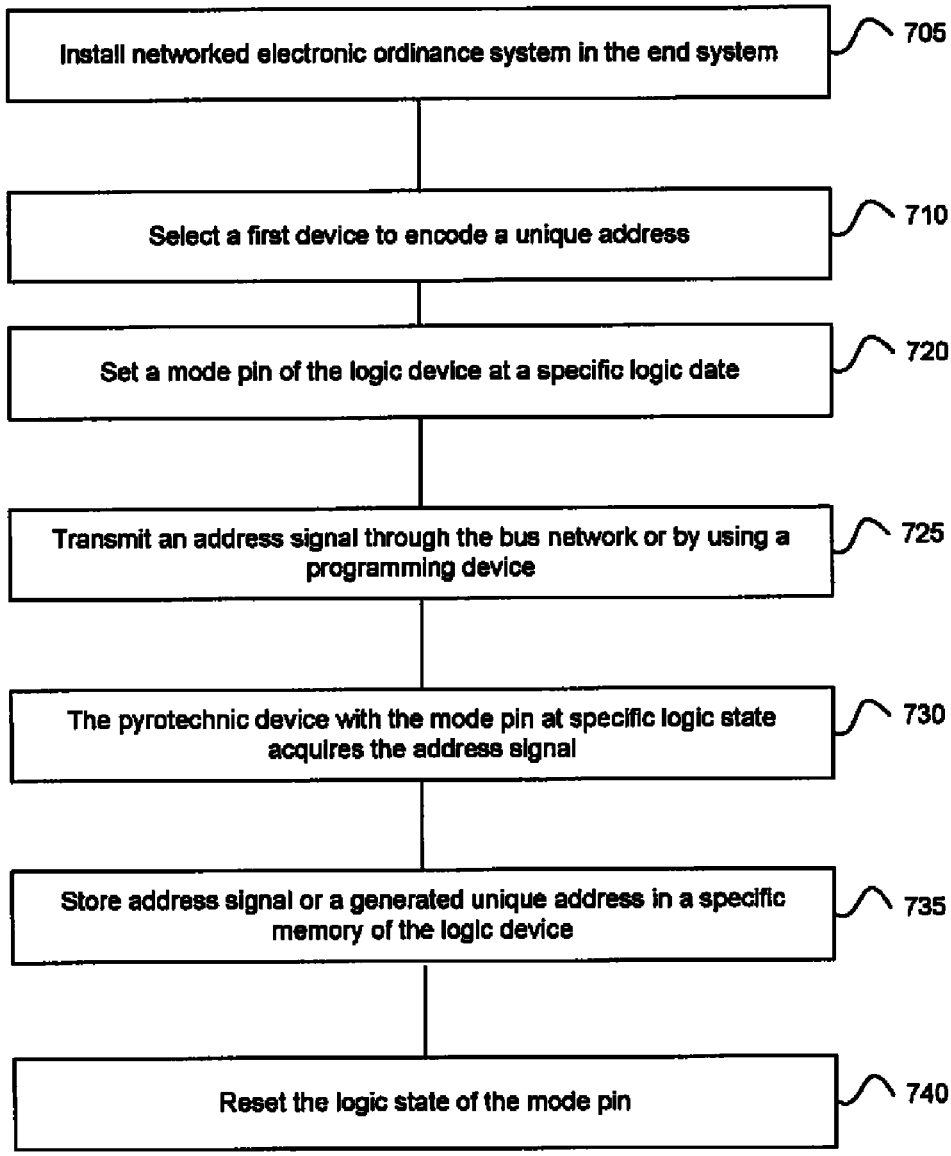
FIG. 7 is a flow chart illustrating a process by which each of the pyrotechnic devices in a networked electronic ordnance system is assigned a unique address.

FIG. 7 is a flow chart illustrating a process by which each of the pyrotechnic devices in a networked electronic ordnance system is assigned a unique address. In one embodiment, as discussed above, the networked electronic ordnance system is installed within an end system 705. The networked electronic ordnance system, in some instances, comprises an ordnance bus controller and multiple pyrotechnic devices connected to a bus network.

The assignment of unique addresses to each pyrotechnic device starts with the selection of a first pyrotechnic device 710. At 720, the mode pin of the logic device of the first pyrotechnic device is set a specific logic state. In one example, as indicated above, the mode pin is temporarily connected to an external programming device to set the mode pin at a logic high value. Subsequent to the mode pin being set at the specific logic state, an address signal is transmitted to the logic device 725. As indicated above, in some instances, this may be accomplished by transmitting the address signal through the bus network. In other instances, the address signal may be clocked into the logic device using the mode pin (by clocking in the address signal, for example, using the external programming device).

Having the mode pin set at the specific logic state enables the logic device of the first pyrotechnic device to acquire the address signal from the network bus 730. In some instances, the logic device generates a unique address based on the received address signal. In other instances, the logic device uses the address signal as the unique address. In either instance, the unique address is subsequently stored in a specific memory of the logic device 735.

Figure 8:
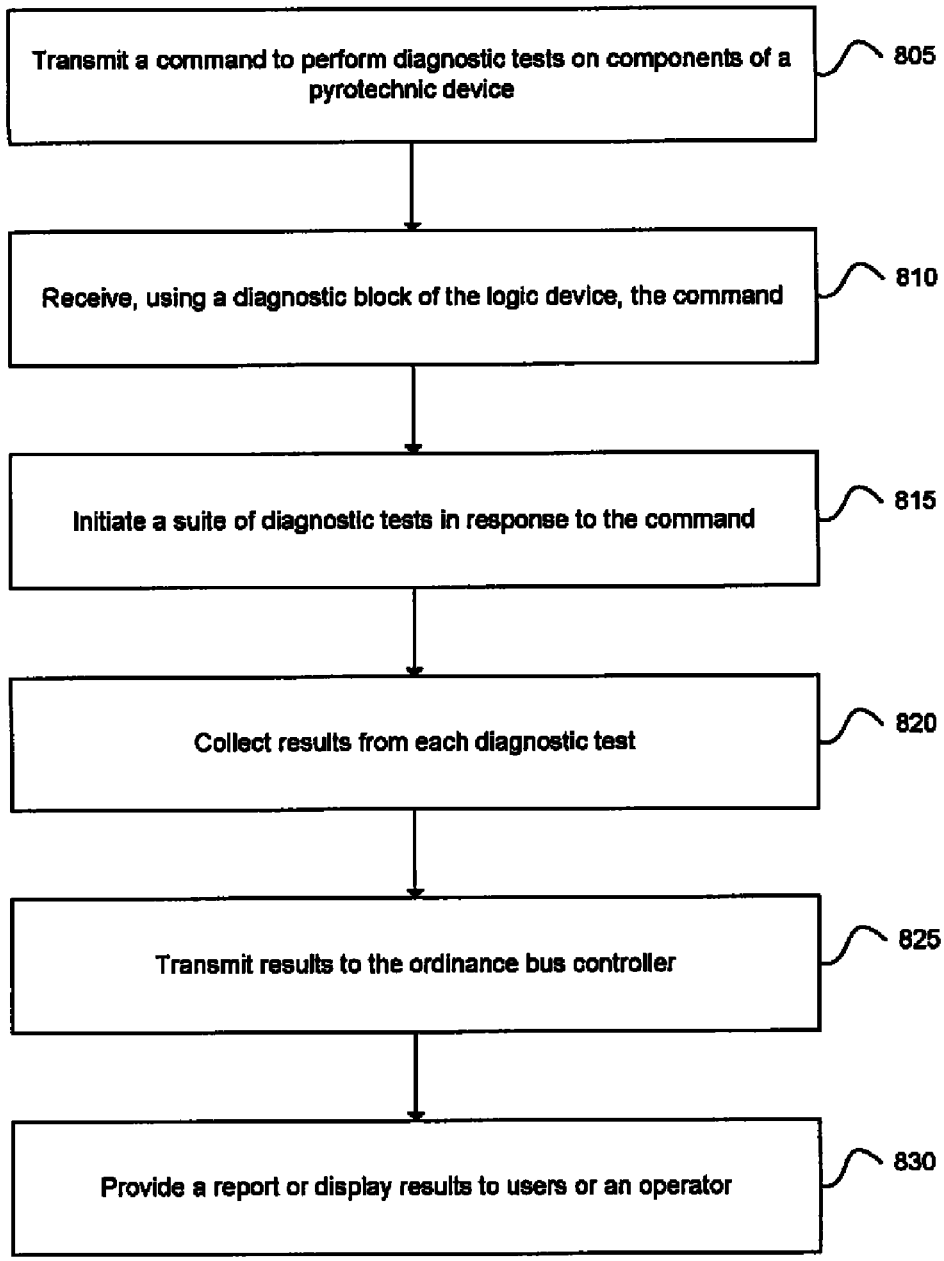
FIG. 8 is a flow diagram depicting a method to perform a suite of diagnostic services within a pyrotechnic device.

FIG. 8 is a flow diagram depicting a method to perform a suite of diagnostic services within a pyrotechnic device. In one embodiment, the ordnance bus controller transmits a command to a pyrotechnic device requesting the pyrotechnic device to perform a suite of diagnostic tests 805. The logic device included in the pyrotechnic device comprises a diagnostic block that is adapted to receive the request received by the logic device 810.

In response to receiving the command to perform diagnostic tests, the diagnostic block of the logic device initiates a suite of diagnostic tests 815. The diagnostic tests, for example, perform integrity checks on various components of the pyrotechnic device. For example, the diagnostic tests cause a controlled amount of current to be transmitted to the firing bridge of the initiator (of the pyrotechnic device) to determine whether the firing bridge is shorted, open, or in normal condition. Similarly, in another example, the firing bridge performs integrity checks on the ERC that is electrically connected to the logic device.

Subsequent to the completion of each of the diagnostic tests, in some instances, the diagnostic block receives the results of all the tests 820. In one embodiment, the diagnostic block generates a code indicating the results of all the tests and transmits the code to the ordnance bus controller 825. In another embodiment, the diagnostic block transmits the result of each diagnostic test, one at a time, to the ordnance bus controller. Upon receiving the one or more diagnostic test results, the ordnance bus controller prepares a report for the user or the operator, or uses a visual medium (e.g., LED indicators, computer monitor, etc.) to communicate the results of the diagnostic tests to a user or operator of the networked ordnance control system.

Figure 9:
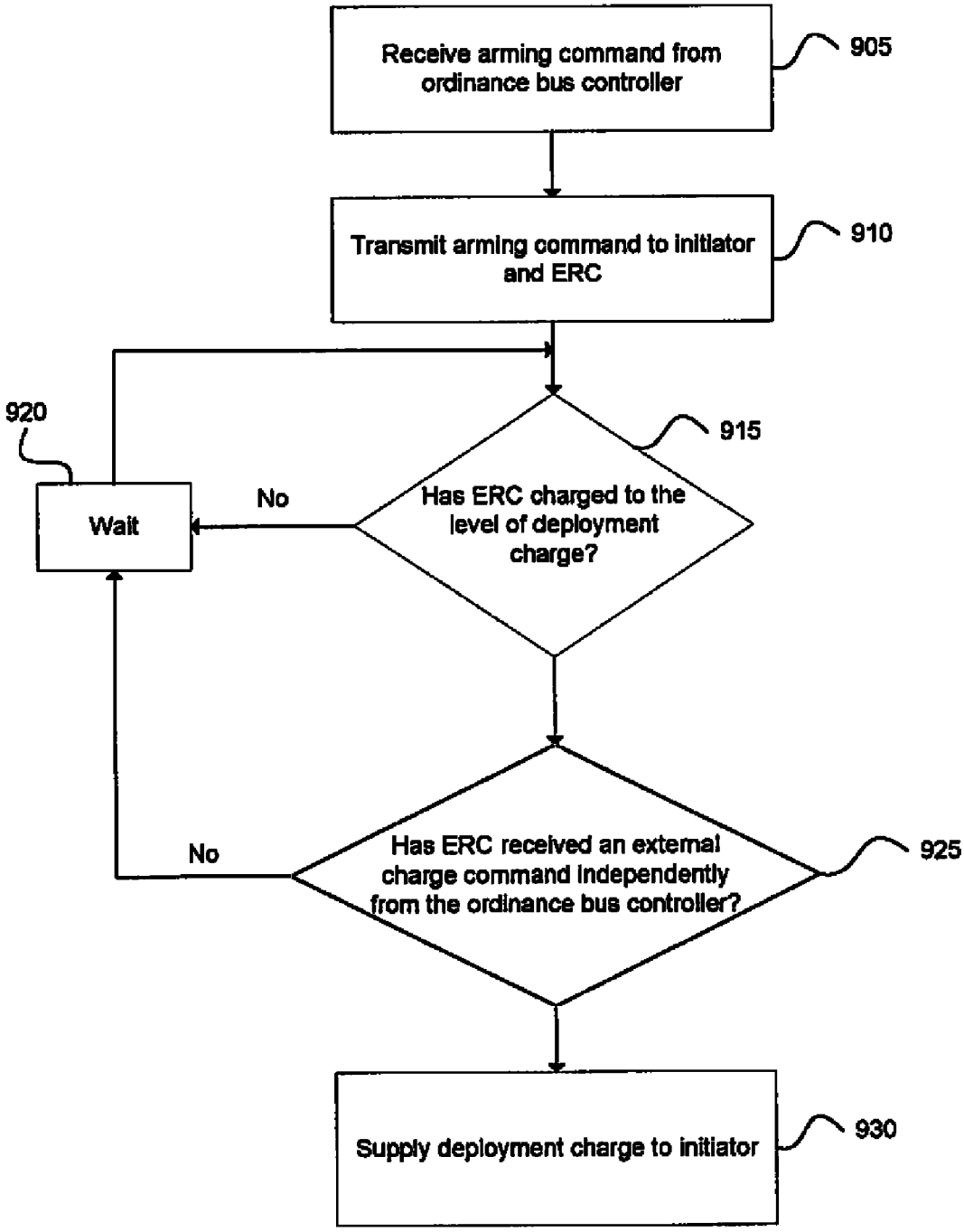
FIG. 9 is a flow diagram illustrating a process by which the ERC supplies a deployment charge to a firing element or initiation device of the initiator.

FIG. 9 is a flow diagram illustrating a process by which the ERC supplies a deployment charge to a firing element or initiation device of the initiator. In one embodiment, the logic device receives an arming or firing command from the ordnance bus controller 905. The logic device then transmits the arming command to the initiator and to the ERC (or, in some instances, a control block for the ERC) 910. Upon receiving the arming command, the ERC uses power received from the network bus to charge up to a deployment charge level. The deployment charge level is the charge applied to the firing element or the initiation device causing it to deploy.

At 915, the process determines whether the ERC has charged up to the deployment charge level. If not, it moves to 920, where it waits for a predetermined amount of time before checking again whether the ERC has reached the deployment charge level. Once the ERC reaches the deployment charge, the process verifies whether the ERC has received an external charge command 925. The external charge command is a safety mechanism implemented in compliance with the safe-by-wire plus standard, and is transmitted independent of the arming command. The ERC has to receive the arm charge command before it can supply the deployment charge to the initiator.

After the ERC independently receives the ERC charge command, it supplies the deployment charge to the initiator, enabling the firing element or the initiation device to deploy. It is noted that steps 915 and 925 need not necessarily follow each other. In some instances, the process may independently check for both parameters without requiring one step to be completed before verifying the other.

The techniques described herein may be embodied in several forms and manners. The description provided above and the drawings show exemplary embodiments of the invention. Those of skill in the art will appreciate that the invention may be embodied in other forms and manners not shown below. It is understood that the use of relational terms, if any, such as first, second, top and bottom, and the like are used solely for distinguishing one entity or action from another, without necessarily requiring or implying any such actual relationship or order between such entities or actions.

Additionally, it will be appreciated to those skilled in the art that the preceding examples and embodiments are exemplary and not limiting to the scope of the present invention. It is intended that all permutations, enhancements, equivalents, combinations, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

We claim:

1. A networked electronic ordnance system, comprising:

a network bus configured to transmit data thereon;

a pyrotechnic device connected to the network bus;

a logic device configured to store a unique address for the pyrotechnic device, wherein the logic device is an integrated circuit associated with the pyrotechnic device, and the integrated circuit is in a housing having a mode pin, and wherein the logic device includes a memory that stores the unique address; and an ordnance bus controller configured to control the network bus and to transmit an address signal to the logic device in situ in an end system during or subsequent to installation of the networked ordnance system in the end system, wherein when the mode pin is set at a specific logic state, the logic device is enabled to accept the address signal and determine the unique address from the address signal.

2. The networked electronic ordnance system of claim 1, wherein the logic device includes a data controller electrically connected to the mode pin.

3. The networked electronic ordnance system of claim 2, wherein the data controller is configured to detect the specific logic state of the mode pin and to acquire the address signal from the network bus upon detection of the specific logic state.

4. The networked electronic ordnance system of claim 3, wherein the data controller is configured to generate the unique address based on the address signal and to store the unique address in the memory of the logic device.

5. The networked electronic ordnance system of claim 4, wherein the unique address stored in the memory is non-rewritable.

6. The networked electronic ordnance system of claim 4, wherein the logic device is configured to not store an address in the specific memory prior to the installation of the networked ordnance system in the end system.

7. The networked electronic ordnance system of claim 1, wherein the networked ordnance system is configured based on a safe-by-wire protocol.

8. The networked electronic ordnance system of claim 1, wherein the logic device includes a diagnostics block.

9. The networked electronic ordnance system of claim 8, wherein the diagnostics block is configured to receive a diagnostics request from the ordnance bus controller.

10. The networked electronic ordnance system of claim 9, wherein the diagnostics block, upon receiving the diagnostics request, is configured to perform a plurality of diagnostic tests on the pyrotechnic device.

11. The networked electronic ordnance system of claim 1, wherein the housing further includes an energy reserve capacitor (ERC) pin, wherein the ERC pin is configured to be electrically connected to an external ERC.

12. The networked electronic ordnance system of claim 11, wherein the logic device includes an ERC controller electrically connected to the ERC pin, further wherein the ERC controller is configured to enable the ERC to provide a deployment charge to the pyrotechnic device subsequent to the pyrotechnic device receiving an arming command.

13. The networked electronic ordnance system of claim 11, wherein the ERC controller is configured to receive a signal external to the arming command to enable the ERC to provide the deployment charge.

14. A method for defining a unique address for a pyrotechnic device networked in an electronic ordnance system, the method comprising:

connecting the pyrotechnic device to a network bus of the electronic ordnance system, wherein the pyrotechnic device is associated with a logic device, further wherein the logic device is an integrated circuit that includes a memory that stores the unique address for the pyrotechnic device;

setting a mode pin of the logic device at a specific logic state to enable the logic device to acquire an address signal from the network bus, wherein the mode pin is included in a package housing the integrated circuit; and encoding the unique address to the specific memory of the logic device, wherein the unique address is encoded to the logic device in situ in an end system during or subsequent to installation of the networked ordnance system in the end system.

15. A method for defining a unique address for a pyrotechnic device networked in an electronic ordnance system as recited in claim 14, the method further comprising:

using an ordnance bus controller to control the addressable bus and to transmit the address signal to the memory of the logic device.

16. A method for defining a unique address for a pyrotechnic device networked in an electronic ordnance system as recited in claim 14, the method further comprising:

detecting, using a data controller, the specific logic state of the mode pin, wherein, the data controller subsequently acquires the address signal from the network bus and generates the unique address based on the address signal.

17. A method for defining a unique address for a pyrotechnic device networked in an electronic ordnance system as recited in claim 16, the method further comprising:

storing the unique address in the specific memory of the logic device.

18. A method for defining a unique address for a pyrotechnic device networked in an electronic ordnance system as recited in claim 16, wherein the unique address stored in the specific memory is non-rewritable.

19. A method for defining a unique address for a pyrotechnic device networked in an electronic ordnance system as recited in claim 16, wherein the unique address is not stored in the specific memory of the logic device prior to the installation of the networked ordnance system in the end system.

20. A method for defining a unique address for a pyrotechnic device networked in an electronic ordnance system as recited in claim 14, further comprising:

performing a plurality of diagnostic tests on the pyrotechnic device in response to a request received from the ordnance bus controller to perform the plurality of diagnostic tests.

21. A method for defining a unique address for a pyrotechnic device networked in an electronic ordnance system as recited in claim 20, wherein the plurality of diagnostic tests includes verifying an integrity of a firing element of an initiator of the pyrotechnic device.

22. A method for defining a unique address for a pyrotechnic device networked in an electronic ordnance system as recited in claim 21, wherein the plurality of diagnostic tests includes verifying an integrity of an ERC included in the pyrotechnic device.

23. A method for defining a unique address for a pyrotechnic device networked in an electronic ordnance system as recited in claim 14, further comprising:

enabling an ERC to provide a deployment charge to the pyrotechnic device subsequent to the pyrotechnic device receiving an arming command.

24. A method for defining a unique address for a pyrotechnic device networked in an electronic ordnance system as recited in claim 23, further comprising:

receiving a signal external to the arming command prior to enabling the ERC to provide the deployment charge to the pyrotechnic device.

25. A networked electronic ordnance system, comprising:

a network bus configured to transmit data thereon;

a pyrotechnic device connected to the network bus;

a logic device configured to store a unique address for the pyrotechnic device, wherein the logic device is an integrated circuit associated with the pyrotechnic device, and wherein the logic device further includes:

a memory that stores the unique address;

a mode pin;

a data controller electrically connected to the mode pin and configured to detect a specific state of the mode pin, wherein the data controller is further configured to receive the unique address from the network bus and store the unique address in the memory subsequent to detecting the specific state of the mode pin; and an ordnance bus controller configured to control the network bus and to transmit the unique address to the logic device in situ in an end system during or subsequent to installation of the networked electronic ordnance system in the end system.

* * * * *